United States Patent [19]

Dobner et al.

[11] Patent Number: 4,736,699

[45] Date of Patent: Apr. 12, 1988

[54] METHOD OF SEWING CORNERS OF A DOUBLE SEAM, WITH A TWO-NEEDLE SEWING MACHINE

[75] Inventors: Reinhold Dobner; Walter Hager, both of Kaiserslautern, Fed. Rep. of Germany

[73] Assignee: Pfaff Industriemaschinen GmbH, Fed. Rep. of Germany

[21] Appl. No.: 84,480

[22] Filed: Aug. 11, 1987

[30] Foreign Application Priority Data

Aug. 13, 1986 [DE] Fed. Rep. of Germany ..... 3627470

[51] Int. Cl.[4] ..... D05B 19/00; D05B 55/16

[52] U.S. Cl. ..... 112/262.3; 112/121.11; 112/221; 112/275; 112/315

[58] Field of Search ..... 112/262.1, 262.3, 221, 112/163, 164, 165, 167, 275, 272, 315

[56] References Cited

U.S. PATENT DOCUMENTS

| | | | |
|---|---|---|---|
| 4,178,862 | 12/1979 | Bianchi et al. | 112/163 X |
| 4,404,919 | 9/1983 | Martell et al. | 112/262.1 X |
| 4,445,449 | 5/1984 | Kuzuya et al. | 112/121.11 |
| 4,526,114 | 7/1985 | Martell et al. | 112/121.11 |
| 4,569,297 | 2/1986 | Dusch | 112/221 |

*Primary Examiner*—H. Hampton Hunter
*Attorney, Agent, or Firm*—McGlew and Tuttle

[57] ABSTRACT

A method of sewing the corners of a double seam, employing a two-needle machine the two needle rods of which each may be mutually independently engaged and disengaged. The method uses control means to arrive at the corner point of the inner seam, disengaging the internal needle rod, furthersewing to the corner point of the outer seam, stopping the sewing machine with the outer needle penetrating the workpiece, then rotating the workpiece, sewing the thus rotated outer seam, and engaging the inner needle rod. The sewing machine comprises at least one adjustable feed dog means, at least one sensor which is disposed ahead of the needles and which triggers the process of positioning the respective needle at the corresponding corner point, said triggering occurring when the edge of the workpiece passes said sensor, a pulse generator coupled to the main shaft of the sewing machine, which pulse generator provides counting pulses for a pulse counter, a microcomputer which controls the operation of the feed dog means in accordance with pulses emitted by the sensor and the pulse generator.

To avoid a shortened stitch in the outer seam when forming stitches with the two needles in the region of the corner point of the inner seam, the stitch formation is carried out in two stitch forming cycles, in the first cycle stitch formation by the outer needle rod is prevented, and the advancing is reduced to the stitch length required to reach the corner point of the inner seam, and in the second cycle the inner needle rod is disengaged and the advancing is reduced to the distance comprising the difference between the normal stitch length (as set) and the stitch length executed in the first cycle.

6 Claims, 2 Drawing Sheets

52
51
50
49
17
12
146
11
13
14
15
16
156
154
157
155
143
144
141
145
112
88
105
142
139
153
6
69
67
66
87
114
137
75
7
127b
118
119
115
131a
85
136
131
140
133
134
132
138
131b
8
65
64
148
3
4
5
P R
P R
P R
151
150
149
147
152

160
161
L1
N1
N2
L
S
S'
70
N1'
P1
P2
L2
L3
E1
P2'
N2'
L4
S"
E2
W
α
159
A
B
158

METHOD OF SEWING CORNERS OF A DOUBLE SEAM, WITH A TWO-NEEDLE SEWING MACHINE

FIELD AND BACKGROUND OF THE INVENTION

In sewing corners with a two-needle sewing machine, in known fashion the inner corner is worked on, after stitch formation the needle which produces the inner seam is inactivated, the outer needle continues to sew into the outer corner, and the machine is disengaged with the outer needle in the down position. After the workpiece is rotated into the new sewing direction, sewing is continued with the outer needle until it comes opposite the inner (corner point, then the inner needle is activated again.

In U.S. Pat. No. 4,526,114, such a method is illustrated and described. According to U.S. Pat. No. 4,526,114 when working on the inner corner the outer and inner needles execute stitches in tandem on the workpiece, when the inner needle executes a shortened stitch to form the corner stitch, the outer needle also executes an identical shortened stitch. In the great majority of cases, this shortening of stitches is required, in order to be able to end the stitching exactly at the predetermined point of the inner seam. The short stitch in the outer seam causes distortion of the entire seam formation. A shortened stitch is only acceptable in the corner region.

A short stitch within a seam structure is undesireable and lowers the quality of the product.

SUMMARY AND OBJECT OF THE INVENTION

It is an object of the invention to devise a method of sewing corners with a two-needle sewing machine, wherein the stitches ahead of and following a given corner stitch are of identical length.

The inventive method solves the above mentioned problem on a two-needle sewing machine which accurately controls arrival at the given corner point by shortening the stitch and provides the possibility of producing a second seam which is not interrupted by a short stitch by use of a needle which continues to sew in cases where the advance by the first needle necessitates a shortened stitch. Thereby a seam is produced which does not have the appearance of a defect.

Accordingly, it is an object of the invention to provide a method of sewing corners of a double seam running any distance from an edge of the workpiece, including an inner seam and an outer seam using a two-needle sewing machine having first and second needles which may be moved mutually independently into an operating position and a disengaing position. The sewing machine is capable of being set at a stitch length L. The method according to the invention includes the steps of computing the distance and the arrival of the inner needle at a corner point of the inner seam, advancing the material to a stitch length L required to reach the detected arrival at the corner point of the inner seam and forming a stitch with the inner needle of the length required while simultaneously preventing stitch formation by the outer needle, advancing the material to a stitch length L equal to the distance between the set stitch length L and the length required for the inner needle to reach the corner point of the inner seam, and forming a stitch with the outer needle so as to form the terminal end of the stitch at the corner point of the outer seam, meanwhile, simultaneously preventing stitch formation by the inner needle.

In accordance with the inventive method, the sewing machine to practice the inventive method includes at least one adjustable feed dog material advancing means, at least one sensor which is disposed upstream or ahead of the needles and which triggers the process of positioning the respective inner and outer needle at the corresponding inner and outer seam corner point, the triggering occuring when the edge of the workpiece passes the sensor. The sewing machine additionally includes a pulse generator coupled to the main shaft of the sewing machine so as to be active only during the transport phase, or the workpiece advancing phase of the feed dog so as to provide counting pulses for a pulse counter corresponding to movement of the workpiece. The sewing machine additonally, advantageously, includes a micro computer which controls the operation of the feed dog or workpiece advancing means in accordance with pulses emitted by the sensor and pulses emitted by the pulse generator.

This arrangment piece allows for controlling the arrival at the corner point of the inner seam so as to allow disengagement of the inner needle rod, further sewing to the corner point of the outer seam, while storing the value of the distance by which the workpiece is advanced between the corner point of the inner seam and the corner point of the outer seam. By use of the control system, sewing may be stopped while the outer needle penetrate the workpiece so that the workpiece may be rotated so that the outer seam may be sewn until the length of the outer seam reaches a value equal to the previously stored advancing distance.

It is still another object of the present invention to provide a method of sewing the corners of a double seam running at a distance from the edge of a workpiece, and an apparatus to perform the method which is simple in design, rugged in construction and economical to manufacture.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

DESCRIPTION OF THE PREFERRED EMBODIMENT

Figure 1:
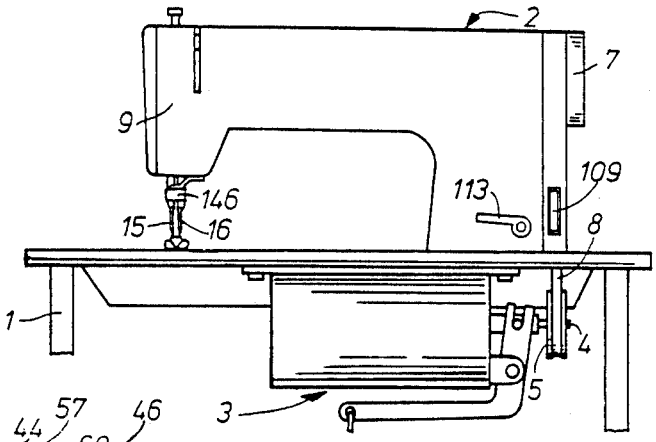
FIG. 1 is an elevation view of a two-needle sewing machine.

The machine frame 1 (FIG. 1) supports a sewing machine 2, which is driven by means of a positioning motor 3. A V-belt pulley 5 is attached to the drive shaft 4 of the motor, and a V-belt 8 passes around pulley 5 and a hand wheel 7. The wheel 7 is provided with its own V-groove and is mounted on the main shaft 6 (FIG. 3) of the sewing machine.

Figure 2:
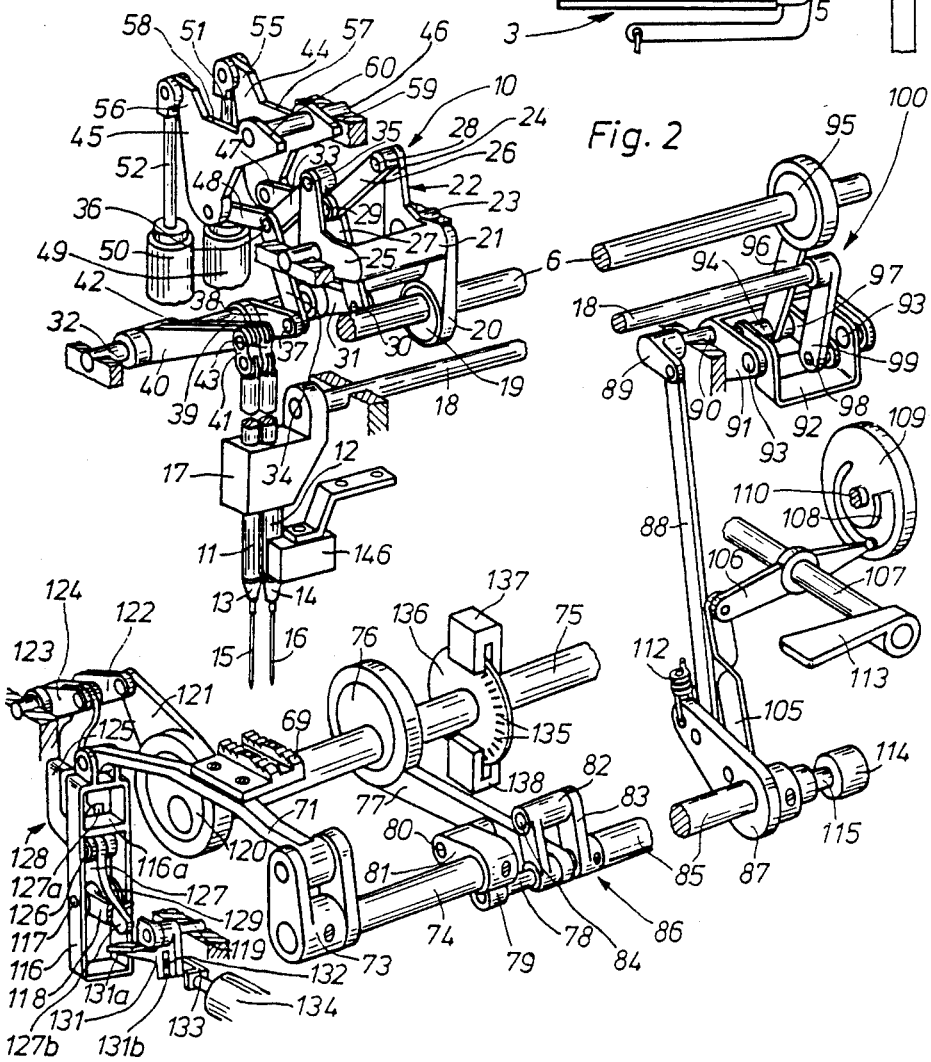
FIG. 2 is a diagrammatic prespective view of the drive mechanism of the sewing machine, with tower workpiece drive mechanism and with needle drive mechanism.

As shown in FIG. 2, a drive mechanism 10 is provided for needle rods 11 and 12 which are disposed in the head 9 of the machine 2. On the lower end of each of the needle rods (11 and 12 respectively, needle holders 13 and 14 are provided for mounting the thread-guiding needles 15 and 16 respectively. The needle rods 11 and 12 are movable up and down in a guide frame 17 which is attached to a swingable shaft 18 which is pivotally mounted in the machine housing. The driving movement for the needle rods 11 and 12 is transmitted via an eccentric 19 which is surrounded by an eccentric rod 20. The free end of rod 20 is pivotally connected to the crosspiece part, 21, of a forked, two-arm lever 22 which is swingably mounted in the machine housing by bearing pins 23, fork members 24 and 25 are connected to crosspiece 21 and act as driven arms.

Arm 24 is connected to a crank arm 31, via an articulated linkage comprising a pair of rods 26 and 27 using pivot pins 28, 29 and 30. Crank arm 31 is connected to an intermediate shaft 32 which is pivotally mounted in the machine housing and runs parallel to the main shaft at a distance therefrom. Fork arm 25 is connected to a crank arm 38, via an articulated linkage comprising a pair of rods 33 and 34 using pivot pins 35, 36 and 37. Crank arm 38 is connected to a bushing 39 which is rotatably mounted on an intermediate shaft. The distance between the bearing pins 23 of the lever 22 and the pivot pins 28 and 35 on the fork arms 24 and 25 is the same as the distance between the pivot pins 28 and 35 and the articulations 29 and 36 respectively of the respective articulated linkage pair 26, 27 and 33, 34.

A crank arm 40 is affixed to the intermediate shaft 32, the free end of which arm 40 is connected to the left needle rod 11 via an intermediate linkage 41; and the bushing 39 has a crank arm 42 mounted on it, the free end of arm 42 is connected to the right needle rod 12 via an intermediate linkage 43.

The switching means for the drive mechanism 10 comprises two stop plates 44 and 45 which are swingably mounted on a bearing pin 46 fixed in the machine housing, and are connected with the link pins 29 and 36 in the articulation of the respective articulated linkage pairs 26, 27 and 33, 34, via respective connecting rods 47 and 48 which act as guiding link rods.

Two simple air cylinders 49 and 50 serve to swing the stop plates 44 and 45. The piston rods 51 and 52 of the respective cylinders 49 and 50 are pivotally connected to respective arms 55 and 56 of the respective stop plates 44 and 45.

In order to kinematically define the operative and inoperative positions for the needle rods 11 and 12, the stop plates 44 and 45 each have two stop surfaces 57, 58 and 59, 60 respectively which interact with detents (not shown) on the interior of the machine housing.

Figure 3:
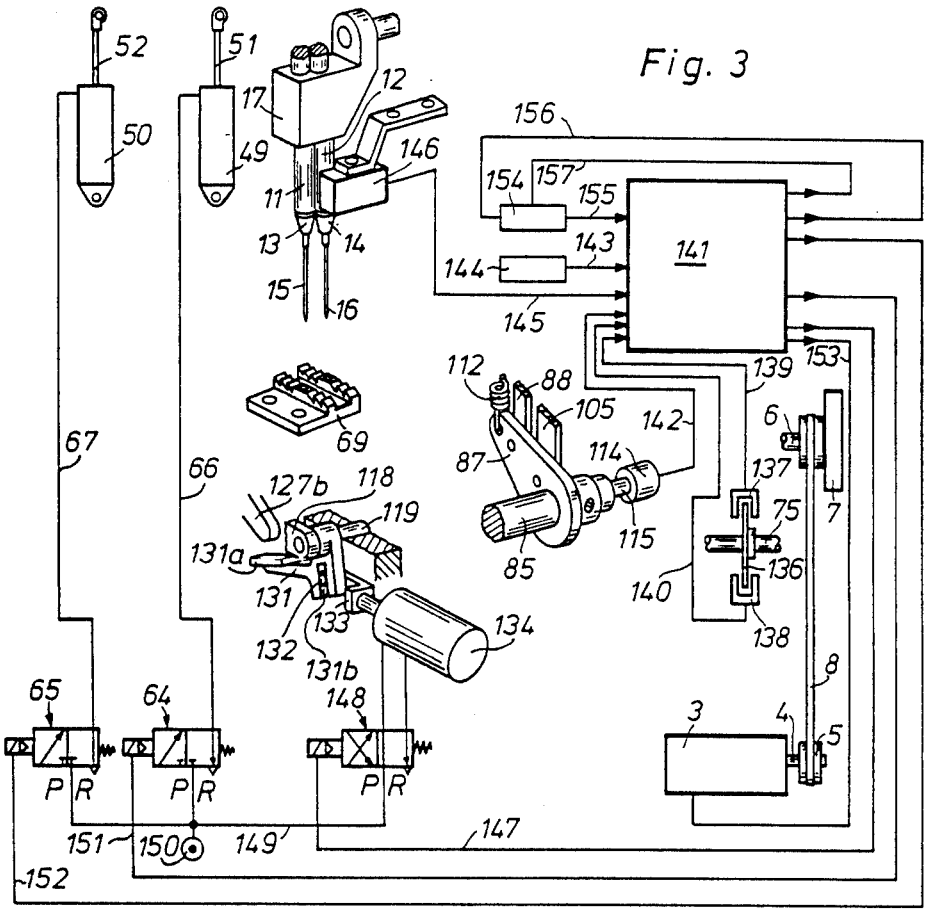
FIG. 3 is a schematic representation of various elements of the control system required for providing a controlled, predetermined end point of a seam; and, FIG. 4 is a schematic illustration of a corner-sewing operation.

As shown in FIG. 3, the pneumatic cylinders 49 and 50 are controlled via pneumatic valves 64 and 65 connected to the cylinders by flexible tubing 66 and 67. Additional features of the drive mechanism 10 for the two needle rods 11 and 12 are described in U.S. Pat. No. 4,569,297.

Rotary hook (not shown) and a material feed dog 69 (FIG. 2) cooperate with the needles 11 and 12. The feed dog 69 is attached to a support 71 which is accommomated under the stitch plate 70 (FIG. 4) of the sewing machine.

The support 71 is connected to a forked crank 73 attached to a rotationally oscillating shaft 74 rotatably mounted in the machine housing. For driving shaft 74, an eccentric 76 is attached to a shaft 75 which is driven by the main shaft 6 at a mechanical ratio of 1:1. The eccentric rod 77 on eccentric 76 is pivotally connected to a pin 78, which in turn is pivotally connected to a link rod 79 which is connected, by a pin 80, to a crank 81 affixed to the shaft 74. The pin 78 also has a link rod 82 pivotally mounted to it, in lateral relationship to the eccentric rod 77. Rod 82 encloses a pin 84 borne by a crank 83. The effective length of rod 79 is equal to that of link rod 82, so that when the two pins 80 and 84 are aligned the shaft 74 remains at rest even if the eccentric rod 77 is moved.

To vary the range of movement of the eccentric rod 77 which movement may have an action on the shaft 74, the crank 83 is rigidly clamped to a setting shaft 85. The members 74, 76 and 85 comprise a setting drive 86 for the magnitude and direction of the stroke of the material feed dog 69. Setting shaft 85 bears a crank 87 connected to another crank 89 via a link rod 88. Crank 89 is connected to another setting shaft 90 which is rotatably mounted in the machine housing. Shaft 90 bears a yoke 91, between the arms of which another yoke 92 is pivotally mounted by means of pins 93. The arms of yoke 92 are connected by a pin 94 which is driven in swinging movement around pin 93 by means of an eccentric rod 96 and an eccentric 95 attached to the main shaft 6. A link rod 97 is pivotally mounted on the pin 94, and is pivotally connected to a crank 99 via a pin 98. One end of crank 99 is affixed to the swingable shaft 18. Members 90–99 comprise a setting drive 100 for the magnitude and direction of the strokes of the needles 15 and 16.

The crank 87 is connected to one end of a rocking lever 106 via a connecting rod 105. Lever 106 is affixed to a shaft 107 which is rotatably mounted in the machine housing. The free end of rocking lever 106 has a spherically shaped projection which extends between the side walls of a control slot 108 in a setting member [lit., "device"] 109 which is mounted on an axle 110 affixed to the housing. By rotating setting member 109, the magnitude of the strokes of the material feed dog 69 and the needles 15 and 16 is established; accordingly the slot 108 has a spiral shape such that the feed dog 69 and needles 15 and 16 can be set for stitch lengths of, e.g., 1–6 mm.

A tension spring 112 engages crank 87. The other end of spring 112 is suspended on the machine housing. The result of the action of spring 112 is that the projection on the rocking lever 106 which engages the setting slot 108 is pressed continuously against the outwardmost wall of the slot 108, and the material feed dog 69 cooperates with the needles 15 and 16 to advance the workpiece in the forward direction. To reverse the material advance direction, a control lever 113 is affixed to the end of shaft 107 which extends outside the machine housing. By pressing lever 113, the rocking lever 106 can be swung against the inwardmost wall of slot 108.

A potentiometer 114 is disposed on the machine housing. The positioning member 115 of potentiometer 114 is rigidly mounted in an axial bore of the setting shaft 85.

The support 71 of the material, feed dog 69 is connected to a frame 116 pivotally mounted on a pin 117 which is also engaged by a lever arm 118 which is pivotally mounted on a pin 119 fixed in the machine housing.

An eccentric 120 is attached to the shaft 75. The eccentric rod 121 is connected to a crank 122 affixed to a shaft 123 which is pivotally mounted in the machine housing. A second crank 124 is mounted on the shaft 123, which crank is connected to one end of a link rod 125 the other—forked—end of which is pivotally connected to a pin 126. A second link rod 127 is pivotally mounted on the pin 126 which rod 127 is supported by the pin 117 and forms an articulated drive linkage in combination with the link rod 125. A torsion spring 129 is mounted on pin 117. One end of spring 129 is braced against frame 116, and the other end acts on link rod 127. Rod 127 has a dog member **127*a* which pushes the torsion spring 129 against a transverse web 16*a* of the frame 116. The link rod 127 is provided with a projection 127*b* which extends into the path of a forcing surface 131*a* of a control member 131 which is pivotally mounted on a pin 119. Control member 131 has a slot 131*b* which serves as a guide for a pin element 132 which is attached to a bracket 133 which in turn is attached to a piston rod of a compressed air piston-and-cylinder device 134**.

The shaft 75 bears a pulse disc 136 having a plurality of dividing marks 135, which disc 136 cooperates with a pair of pulse generators 137 and 138 disposed 180° apart. The pulse generators are connected to a microcomputer 141 (FIG. 3) via electrical connections 139 and 140 respectively.

The dividing marks 135 (FIG. 2) are provided only on part of the impulse disc 136, namely that part which passes through the pulse generator 13 during the transport phase of the material feed dog 6 and needles 15 and 16. In this way, pulses are produced from generator 137 only during the transport phase of the sewing machine, and are passed over connection 139 (FIG. 3) to the microcomputer 141; and generator 138 sends pulses to the microcomputer 141 only during the non-transport phase.

One input of the microcomputer is connected to the potentiometer 114 via a conductor 142. Another input is connected to a data input device 144 (shown schematically) via an electrical connection 143; and still another input is connected to a sensor 146 via electrical connection 145. Sensor 146 is affixed to the machine housing ahead of the needles 15 and 16 and above the stitch-forming location.

One output of the microcomputer 141 is connected to the control magnet of a 4/2-way servo valve 148 via an amplifier (not shown) and a conductor 147. The servo valve 148 provides controlled pressurization of the compressed air cylinder 134, and is connected to a compressed air source 150 via a flexible tube 149 which is also connected to valves 64 and 65. The control [electro] magnets of valves 64 and 65 are also connected to outputs of the microcomputer 141, via amplifiers (not shown) and conductors 151 and 152 respectively. Another output of the microcomputer 141 is connected to the control switch of the positioning motor 3, via a connection 153.

Finally, a counter 154 is connected to an input of the microcomputer 141 via a conductor 155, and to an output of the microcomputer via a conductor 156. The counter 154 is resettable to zero by means of another output of the microcomputer 141, to which the counter is connected by a conductor 157.

The microcomputer 141 processes the incoming pulses from the pulse generator 137 and the sensor 146, in a manner which is per se known. It also receives the values correlated with the rotational position of the potentiometer 114, which values represent the stitch length to which the machine is set at the time. Alternatively, instead of using the potentiometer, the desired stitch length can be input to the microcomputer 141 manually over the data input device 144, when a change in the setting is desired.

When the desired stitch length L is set using the setting member 109, the setting shaft 85 is rotated via the rocking lever 106, the connecting rod 105, and the crank 87. At the same time, the resistance of the potentiometer 114 (connected to the setting shaft 85) is changed correspondingly, and this value is input to the microcomputer 141 via the conductor 142.

Advantageously, the sensor 146 contains two sensor elements disposed next to each other, which elements each comprise a light source and a light receiver. These elements serve, in known fashion, to determine the magnitude of the corner angle alpha of the workpiece W, with the aid of which the microcomputer 141 calculates the necessary pulse values for positioning the inner and outer corner points (E1, E2) of the double seam.

The sensor 146 disposed at a distance ahead of the path of the needles 15 and 16 on the head 9 of the sewing machine 2 cooperates with a reflective foil 158 adhesively bonded to the stitch plate 70 of the machine 2. The light emitted by the light sources of the sensor elements of the sensor 146 falls on a scanning point (A, B, respectively). If a given such point is not covered by the workpiece W, the light is reflected back to the light receiver of the given sensor element. As soon as an edge 159 of the workpiece W (e.g. a collar) moves over the scanning point A, the workpiece W interrupts the reflected light of the associated beam, and the sensor 146 sends a switching pulse to the microcomputer 141 via the conductor 145.

In operation., with the needle rods 11 and 12 in engagement as per FIG. 2, the main shaft 6 of the machine 2 is driven by the engaged controlled positioning motor 3, via the V-belt pulley 5, V-belt 8, and hand wheel 7 attached to said shaft 6. Swinging movement is imparted to the lever 22 via the eccentric 19 (attached to the main shaft 6) and the eccentric rod 20. This movement is transmitted to the oscillating shaft 32, via the pair of articulated link rods 26 and 27 and the crank arm 31; and from shaft 32 the left needle rod 11 is moved up and down, via the crank arm 40 and the intermediate link rod 41. At the same time, swinging movement is imparted to the bushing 39 which is coaxial to oscillating shaft 32, via the pair of articulated link rods 33 and 34 which are connected to the driven arm 25 of the lever 22, and the crank arm 38; and from bushing 39 the right needle rod 12 is moved up and down, via crank arm 42 and intermediate link rod 43.

During the formation of the double seam comprised of seams N1 and N2 on workpiece W, a report is received from, e.g., sensor 146 that the edge 159 of the workpiece W has left exposed the scanning point A on the stitch plate 70 (i.e., on the reflective foil 158 adhesively bonded thereto), resulting in the sensor 146 sending a switching pulse to microcomputer 141 via conductor 145. In turn, the microcomputer switches the positioning motor 3 to a predetermined low rpm value, via the conductor 153. With the positioning motor 3 then running at low rpm, when the predetermined corner points E1 and E2 are later reached, the machine 2 will stop.

At the same time, counter 154, which has been reset to zero, is switched into connection with the conductor 139 of the pulse generator 137, by means of the microprocessor 141, via conductor 156. Thereafter, when further sewing takes place, the pulses generated by the pulse generator 137 will each cause an increase in the count by counter 154.

Figure 4:
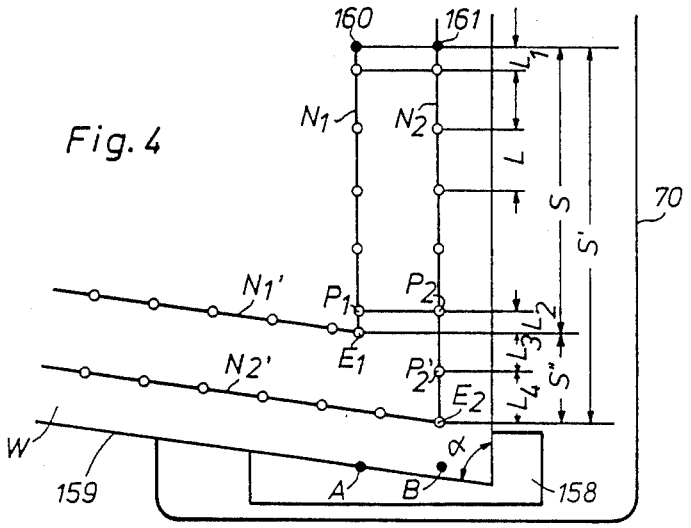

The switching-in of the counter 154 occurs during the transport phase of the machine 2, because that is the only time during which the edge 159 of the workpiece W moves over the scanning point A. In FIG. 4, the points 160 and 161 indicate the positions of the needles 15 and 16 at the instant the counter 154 is switched in. After the edge 159 of the workpiece W passes over the second scanning point B, the sensor 146 sends a second pulse to the microcomputer 141, the micro computer then can calculate the correct distances S and S' from the response of the scanning point A to the two corner points E1 and E2 which are to be subjects of control.

The counter 154 counts the pulses generated by the pulse generator 137 during the leftover (remaining) stitch length L1, from the generation of the first switching pulse by the sensor 146 to the completion of the already begun stitch. The microcomputer 141 queries the pulse count at the completion of the "leftover" stitch; and immediately thereafter it calculates (based on the distance S and the set stitch length L) the number of complete stitches to be executed following the "leftover" stitch L1, and also calculates the pulse count for the difference between the stitch length L and the calculated leftover stitch length L2 for the last, shortened stitch L2 prior to the corner point E1.

After execution of the calculated number of normal stitches each with stitch length L, i.e. after stitching to points Pl and P2, the microcomputer 141 controls the inactivation of the right needle rod 12, which is caused to stop at its upper dead point. This is brought about in a first stitch-formation cycle in that the microcomputer 141, via connection 152, switches the pneumatic valve 65 into the "on" position wherein the working piston of the pneumatic cylinder device 50 is subjected to compressed air from the compressed air source 150, via the flexible tube 151 and the pump connection P of the valve 65, whereby the piston rod 52 is forced downward. Rod 52 causes stop plate 45 to swing counterclockwise around bearing pin 46 until the stop surface 60 on the stop plate 45 comes to rest against the corresponding detent which determines the disengaged position of the right needle rod 12. The swinging of the stop plate 45 causes the articulated pair of link rods 33 and 34 to be moved out of the engaged position shown in FIG. 2 and into the disengaged position, via the connecting rod 48 which connects to their articulation 36. In this disengaged position the longitudinal axis of the pivot pin 23 of rod pair 33 and 34 and the longitudinal axis of the pivot pin 23 of lever 22 are aligned, and needle rod 12 is in its highest position. In this position of the drive parts, the link rod 33 executes purely rotational oscillatory movements around pivot pin 36, so that no driving movements are transmitted to the needle rod 12.

At the same time, the microcomputer 141 actuates compressed air cylinder 134 via servo valve 148, prior to the execution of (i.e., movement of the workpiece through) the leftover stitch length L2, at a time at which the prior advance of the workpiece W by the material dog feed 69 and the needle rods 15 and 16 has just ended.

The piston of compressed air cylinder device 134 (FIG. 2), via pin element 132, swings forcing surface 131*a* against the projection 127*b* on link rod 127, thereby raising said projection, and surface 131*a* then presses against the bottom side of lever arm 118, causing arm 118 to swing by an amount determined by the end of the stroke of the adjustably mounted air cylinder 134. This process causes the articulated link rod mechanism 128 to swing outward, in consequence of the swinging of projection 127*b*, thereby disturbing the firm connection between the frame 116 and the crank 124. The additional swinging of the lever arm 118 results in lifting of the frame 116 (under the action of forcing surface 131*a*), whereby the support member 71 bearing the material feed dog 69 is swung upward. As a result, the teeth of feed dog 69 are moved through the stitch plate 70. At the same time, the microcomputer 141 (FIG. 4) resets the counter 154 to zero, via conductor 157, and switches conductor 139 to "off" and conductor 140 to "on".

The pulse generator 138 now delivers pulses to the counter 154, via computer 141 and conductor 140, until the count in counter 154 reaches a value i' corresponding to the difference between the normal stitch length L and the calculated leftover stitch length L2 for the last, shortened stitch.

In the sequence of events just described, the workpiece W is moved by a distance which equals the difference between stitch length L and leftover stitch length L2, by the rearward movement of the needle 15 and the material feed dog 69. When the count, in the counter 154, reaches i' the counter 154 sends a pulse to the microcomputer 141 via conductor 155, whereby microcomputer 141 abruptly disengages air cylinder 134 via conductor 147 and servo valve 148, whereupon control member 131 is swung back to its lower end position.

Under the influence of torsion spring 129, the two link rods 125 and 127 are then returned to their extended position up to the point where stop member 127*a* lies against frame 116, whereby frame 116 is moved downward, and the material feed dog 69 is lowered below the stitch plate. After the feed dog 69 is retracted, the needle 15 and feed dog 69 move back by the distance of the leftover stitch length L2, to their starting positions, without transporting the workpiece, whereupon the needle 15 then stitches a distance L2 on the workpiece from the last stitch which had length L. Accordingly, the last stitch before the corner point E1 has only the leftover stitch length L2.

The stitch formation cycle for producing the leftover stitch L2 on the seam N1 is thus completed, and a second stitch formation cycle begins for producing a normal stitch with length L, in seam N2, parallel to the stitch, in seam N1, with length L2.

As soon as the last stitch, with length L2, is completed in seam N1, the microcomputer 141 switches the pneumatic valve 65 back to its null position, via conductor 152, whereby air cylinder 50 is depressurized, via flexible tube 67 and valve 65 (which is returned (R) to its original position). The working piston of air cylinder 50 is thereby pushed upward, and thereby the stop plate 45 is swung clockwise around pivot pin 46, into the engagement position of right needle rod 12, whereby the stop surface 59 is moved up against the associated detent which determines the engaged position. When the stop plate 45 is swung, the articulated pair of link rods 33 and 34 is moved into the engagement position for the needle rod 12, via the connecting rod 48.

At the same time, the microcomputer 141 switches pneumatic valve 64 into the "on" position, via conductor 151, whereby the left needle rod 11 is disengaged via air cylinder 49, in a manner similar to the disengagement of needle rod 12 discussed above.

The microcomputer 141 calculates the leftover stitch length L3 remaining to be executed, which equals the difference between the normal stitch length L (of the given setting) and the leftover stitch length L2 in the inner seam N1. This length L3 is namely the length remaining to achieve a stitch length of L.

$$L3 = L - L2.$$

At the same time, the microcomputer 141 calculates the number of pulses which are experienced during advancing movement from corner point El to corner point E2, which number corresponds to a distance S"; and this calculated number is stored.

In the second stitch formation cycle, for stitch formation in the region of the inner corner point E1 of seam N1, the advance is reduced to the calculated stitch length L3, wherewith the microcomputer 141 brings about a backward movement of the workpiece W by a distance L2, in a manner similar to that described above for seam N2, namely by appropriate temporary actuation of air cylinder 134 via servo valve 148, prior to the execution of the leftover stitch length L3.

The effective stitch lenqth negotiated by the outer needle 16 in these two stitch cycles is thus exactly the normal stitch length L.

Additional stitches with length L may be sewn by outer needle 16 prior to the point P2' from which a leftover stitch length L4 must be executed to reach outer corner point E2 i.e., in a situation (not shown) where the distance $(S'' - L3) > L$.

Similarly to the above description, the microcomputer 141 controls the actuation of air cylinder 134 for adjustment for the corner stitch with stitch length L4; resets counter 154 to zero; and shuts off pulse generator 137 and turns on pulse generator 138.

Pulse generator 138 sends pulses to counter 154 via conductor 140 and microcomputer 141, until the pulse count in counter 154 reaches i", corresponding to the difference between stitch length L and the calculated leftover stitch length L4 for the final, shortened stitch.

In the sequence just described, the workpiece is moved rearward (by material feed dog 69) with the rearward movement of the needle 16 and the feed dog 69, said movement being by the distance (L−L4). When the count in the counter 154 reaches i", the counter 154 sends a pulse to the microcomputer 141 via conductor 155, whereby microcomputer 141 abruptly disengages air cylinder 134 via conductor 147 and servo valve 148, whereupon control member 131 is swung back to its lower end position.

In this way, as described supra, the material feed dog 69 is lowered below the stitch plate. After the feed dog 69 is thus lowered, the needle 16 and feed dog 69 move back by the distance of the leftover stitch length L4, to their starting positions, without transporting the workpiece W, whereupon the needle 16 then stitches a distance L4 on the workpiece, from the last stitch which had full length. Accordingly, the last stitch before the corner point E2 has only the leftover stitch length L4.

At the same time that air cylinder 134 is shut off, the microprocessor 141 sends a shutoff command to the positioning motor 3, via conductor 153, whereby the machine 2 is then held in the lowered position of needle 16, in known fashion. Thus the seam is ended exactly at the predetermined corner point E2, whereupon the workpiece W is rotated around the needle 16 (which now serves as a pin to fix the center of rotation).

At the same time, the microcomputer 141 turns pulse generator 137 on, via conductor 139, and turns pulse generator 138 off, via conductor 140.

After workpiece W has been rotated into the new position, the machine 2 is started again, and first only the outer seam N2, is sewed, using needle rod 12. As soon as seam N2' reaches a length corresponding to a leftover length (S"−L) such that outer needle 16 cannot execute another stitch with length L without passing the inner corner point E1, microcomputer 141 causes needle rod 11 to be engaged. From this point on, the sewing of the double seam proceeds on both seams (N1', N2').

There are other ways of achieving the prevention of stitch formation in the outer seam N2 in the first stitch formation cycle when the corner stitch in corner point E1 of the inner seam is being formed—ways other than merely disengaging the outer needle rod 12. The said restriction can also be accomplished by the known technique of failing to catch the loop of the thread of needle 12 by the associated hook means. With such a technique, the needle 16 proceeds to execute the stitch in the workpiece W, thereby forming a stitch hole in it, but actual stitch formation is not accomplished. Only in the second stitch formation cycle is a stitch formed, namely a stitch with length L, executed in outer seam N2.

Obviously, the invention is not limited to a sewing method with a two-needle machine of a type which employs needle translation in addition to transport of the material feed dog, and which therefore is well suited for sewing corner seams in workpieces which are difficult to work with. However, a two-needle machine suitable for the inventive method must operate with transport of the workpiece from underneath. This feature simplifies the electronic control, because each stitch shortening takes place during the advancing phase of the material feed dog, during which also the needles are engaged and disengaged.

While a specific embodiment of the invention has been shown and described in detail to illustrate the application of the principles of the invention, it will be understood that the invention may be embodied otherwise, without departing from such principles.

What is claimed is:

1. A method of sewing corners of a double seam running at a distance from the edge of the workpiece, including an inner seam and an outer seam, using a two-needle sewing machine having first and second needles which may be moved mutually and independently into an operating position and a disengaging position the sewing machine having a stitch length which may be set at a length L, the method comprising the steps of: computing the distance and the arrival of the inner needle at a corner point of the inner seam; preventing stitch formation by the outer needle; simultaneously advancing the material to a stitch length required to reach the detected arrival at the corner point of the inner seam and forming a stitch of the required length with the inner needle while stitch formation by the outer needle is prevented; preventing stitch formation by the inner needle; subsequently advancing the material to a stitch length equal to the difference between the normal set stitch length and the stitch length required to reach the corner point of the inner seam and forming a stitch with the outer needle while stitch formation of the inner needle is prevented, the stitch length terminating at the corner point of the outer seam.

2. A method according to claim 1 further comprising the steps of: using a control means, an advancing means and a detection means, the control means being responsive to the movement of the advancing means and the detection by the detection means of the arrival at the corner point of the inner seam, thereby allowing the computation of the distance of the arrival of the inner needle at the corner point of the inner seam and the calculation of a stitch length required to reach the corner point of the inner seam and the stitch length required to reach the corner point of the outer seam.

3. The method according to claim 2 further comprising the steps of: stopping the sewing machine with the outer needle penetrating the workpiece at the corner point of the outer seam; rotating the workpiece; sewing the outer seam of the rotated workpiece and subsequently engaging the inner needle.

4. A method of sewing corners of a double seam running at a distance from an edge of a workpiece using a double needle sewing machine having an inner needle for forming an inner seam and an outer needle for forming an outer seam, the outer and inner seam each having a set stitch length L, means for selectively engaging and disengaging each of the inner and outer needles, feed dog means for advancing the workpiece; a sensor means for detecting the edge of the workpiece as the workpiece is advanced and micro computer means responsive to the feed dog means and the sensor means for controlling the engagement and disengagement of the inner and outer needles and for controlling the feed dog means, the method comprising the steps of: detecting the workpiece edge as the workpiece is advanced; computing the arrival of the inner needle at the corner of the inner seam; disengaging the outer needle after the inner needle and outer needle have made the last stitch of set length L before the inner needle reaches the corner of the inner seam; advancing the workpiece, while the outer needle is disengaged, a stitch length required to reach the corner of the inner seam and forming a stitch length L2; disengaging the inner needle; advancing the workpiece a distance equal to the difference between the stitch length L and the stitch length L2, while the inner needle is disengaged, and forming a stitch, with the outer needle, of length L; and, advancing the workpiece, while the inner needle is disengaged, a stitch length required to reach the corner of the outer seam and forming a stitch of length L4.

5. The method according to claim 4 further comprising the steps of: subsequent to advancing the workpiece while the inner needle is engaged and forming a stitch of length L4, stopping of the sewing machine with the outer needle penetrating the workpiece; subsequently rotating the workpiece; advancing the workpiece while the inner needle is disengaged; a stitch length equal to length L4; and, subsequently advancing the workpiece a stitch length L and continuing double seam stitching of stitch length L.

6. A sewing machine for sewing corners of a double seam running at a distance from an edge of a workpiece comprising: an inner needle for forming an inner seam; an outer needle for forming an outer seam; means for selectively engaging and disengaging each of the inner and outer needle; a feed dog means for advancing the workpiece along a feed path; sensor means along the feed path for detecting the edge of the workpiece as the workpiece is advanced; and, microcomputer control means, connected to and responsive to the feed dog means and the sensor means, for controlling the engagement and disengagement of the inner and outer needles, for controlling the feed dog means and for computing the amount of feed movement necessary for arrival of the inner needle at the corner of the inner seam to form a stitch length required to reach the corner of the inner seam.

* * * * *